United States Patent [19]

Stewart

[11] Patent Number: 4,932,668

[45] Date of Patent: Jun. 12, 1990

[54] INVESTMENT BOARD GAME

[76] Inventor: Steven R. Stewart, 12001 Foothill Blvd. #28, Lakeview Terrace, Calif. 91342

[21] Appl. No.: 306,154

[22] Filed: Feb. 2, 1989

[51] Int. Cl.[5] ..... A63F 3/00

[52] U.S. Cl. ..... 273/256; 273/243

[58] Field of Search ..... 273/256, 278

[56] References Cited

U.S. PATENT DOCUMENTS

| | | | |
|---|---|---|---|
| 2,026,082 | 12/1935 | Darrow | 273/256 |
| 2,693,961 | 11/1954 | Ripley | 273/256 |
| 4,062,544 | 12/1977 | Hankins | 273/256 |
| 4,456,260 | 6/1984 | Hilton | 273/256 |

*Primary Examiner*—Benjamin Layno

*Attorney, Agent, or Firm*—Donald J. Breh

[57] ABSTRACT

A board game is disclosed including a game board having a game path subdivided into a plurality of developed property spaces having associated businesses, undeveloped property spaces having zoning designations for permitting development with different types of businesses. The types of businesses permitted to be developed on one undeveloped property being different from at least one other undeveloped property. The game further includes building permit cards, each listing the different types of businesses permitted to be developed on the undeveloped properties. The game involves buying and developing property and collecting rent and dividends while subjected to financial events including financial audits, tax, chance situations and charitable events with the object being to build the greatest financial worth.

14 Claims, 3 Drawing Sheets

Fig. 1
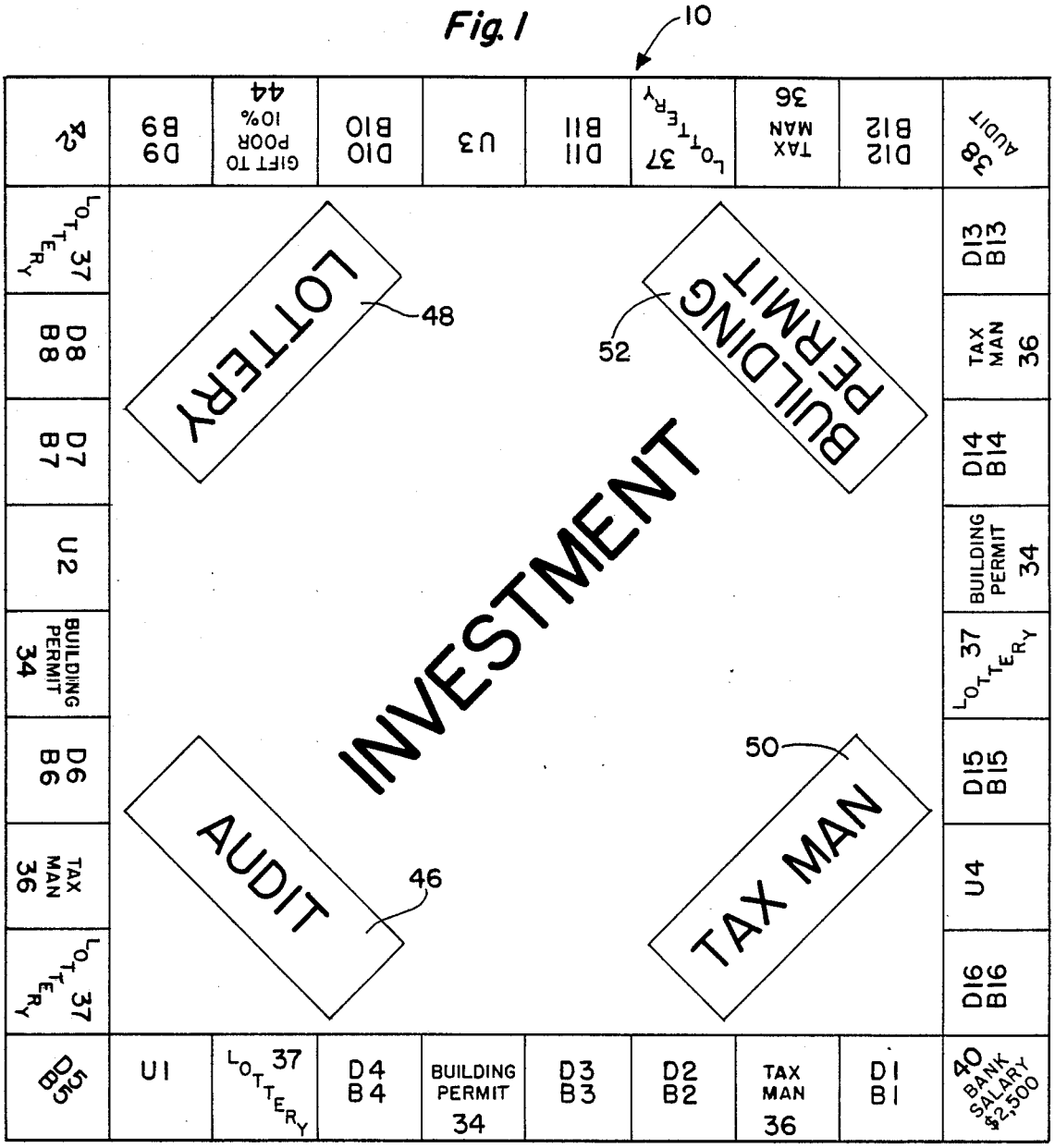
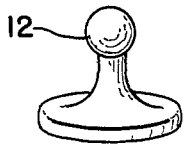
Fig. 2
Fig. 4a
24
| BUILDING PERMIT COST: $150.00 | COST | DIVIDEND |
|---|---|---|
| FLOPPY BURGER FRANCHISE: | $ 2,500.00 | $ 600.00 |
| VIDEO MAGIC VIDEO STORE: | $ 2,250.00 | $ 500.00 |
| ACE COMPUTER, INC.: | $ 5,000.00 | $ 1,500.00 |
| APARTMENT COMPLEX: | $10,000.00 | $ 2,500.00 |
| CONDOMINIUM: | $15,000.00 | $ 3,000.00 |
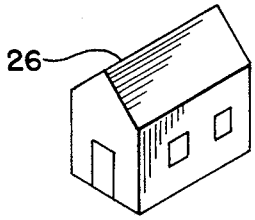
Fig. 3
Fig. 4
24
BUILDING PERMIT

PENALTY

TAX FILING ERROR. AUDIT SHOWS ERROR IN FILING INCOME TAX. PAY BOARD BANK 10% CASH ON HAND.

18

AUDIT

18

TAX ASSESED FOR CASH ON HAND. PAY 10% CASH ON HAND TO BOARD BANK.

16

TAX MAN

16

WINNING NIGHT AT BINGO PARLOR. COLLECT $100 FROM EACH PLAYER.

20

LOTTERY

20

28

23

DEED
PROPERTY
NORTH AVENUE
2 ACRES UNDEVELOPED

| | |
|---|---|
| COST: | $2,000 |
| UNDEVELOPED RENT: | $ 100 |
| DEVELOPED RENT: | $ 300 |
| MORTGAGE VALUE: | $ 1,000 |

Fig. 9

22

DEED
PROPERTY
MAIN STREET NO. 1

| | |
|---|---|
| COST: | $100,000 |
| RENT: | $ 5,500 |
| MORTGAGE VALUE: | $ 50,000 |

Fig. 10

25

DEED
BUSINESS
TANNER TRAVEL
AGENCY

| | |
|---|---|
| COST: | $5,000 |
| DIVIDEND: | $ 350 |
| MORTGAGE VALUE: | $ 2,500 |

Fig. 11

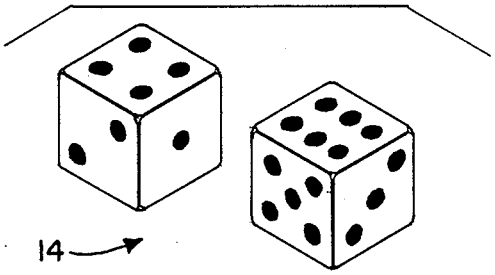

Fig. 12

U1

2 ACRES UNDEVELOPED
PROPERTY
NORTH AVENUE

| PROPERTY | | ZONED IV |
|---|---|---|
| COST: | $2,000 | ANY COMMERCIAL |
| RENT: | $ 100 | DEVELOPMENT |
| DEVLD. RENT: | $ 300 | UP TO: |
| M.V.: | $ 1,000 | 2 CONDOS |
| | | 2 APT. BLDG. |

Fig. 13

D4
B4

DEPARTMENT OF
WATER
WATER STREET

| PROPERTY | | BUSINESS | |
|---|---|---|---|
| COST: | $100,000 | COST: | $2,000 |
| RENT: | $ 5,500 | DIVIDEND: | $ 150 |
| M.V.: | $ 50,000 | M.V.: | $ 1,000 |

Fig. 14

INVESTMENT BOARD GAME

BACKGROUND OF THE INVENTION

This invention relates to board games and in particular to a board game involving investment situations principally related to real estate development with businesses and financial consquences effecting personal wealth with the object being to be the player to accumulate the greatest wealth.

Many different board games having business and investment themes have been devised, all of which have their own unique features. Some games require substantial knowledge of certain industries such as real estate or construction and present situations that are complicated and demanding and require a higher degree of skill and concentration than perhaps the less sophisticated player would have or even be able to effectively understand in order to play. The classic game Monopoly is one game of the general type relating to investment in property to which the game of the present invention is related. Other representative board games are disclosed in U.S. Pat. Nos. 4,648,601; 4,386,778; 4,179,128; 4,456,260 and 4,382,602. As noted, all of these games have their own unique features and the present board game is directed to a game that is enjoyable by a large number of persons and in general does not require unusually great business or financial knowledge to play and provides an interesting variation from the present investment, real estate and financial theme-type games available.

SUMMARY OF THE INVENTION

According to the invention, there is provided a board game having an investment theme including a game board including a path subdivided into a plurality of developed and undeveloped property spaces and spaces for triggering different randomly determined consequences either adverse or favorable to the player.

According to an important aspect of the invention, the spaces for triggering the adverse consequences at least include a tax consequence space and a plurality of tax cards defining different tax consequences.

Another aspect of the invention provides for a further space for triggering adverse consequences including an "Audit" space and a plurality of "Audit" cards defining different financial consequences.

A still further important aspect provides for yet another space for triggering an adverse consequence including a space for triggering bankruptcy of a player.

According to the invention, the spaces for triggering favorable consequences include chance spaces and a plurality of favorable consequence cards relating to generally unforseeable situations.

According to one feature, the chance spaces and favorable consequence cards associated therewith are referred to a "Lottery" spaces and "Lottery" cards.

Another space for triggering a favorable consequence is a "Bank/Salary" space for triggering the payment of a predetermined sum of money to a player.

Another feature provides for some of the "Audit" game cards to include consequences favorable to a player.

According to a very important aspect of the invention, each developed property space has a property purchase cost and an associated business purchase cost, a property rental and mortgage value and a business dividend and mortgage value. Each undeveloped property space has an undeveloped property purchase cost, developed and undeveloped rental values a mortgage value and a zoning designation.

A still further important aspect of the invention provides for the game path to include a plurality of "Building Permit" spaces and a plurality of "Building Permit" game cards defining the cost and dividend values of different business types which are permitted to be developed in the different zoning designations.

A still further feature of the invention provides for the game path to include a charitable gift space labeled "Gift to Poor 10%" triggering the payment of a sum of money by a player.

A still further feature of the invention provides for a plurality of "Deed" cards representing each developed and undeveloped property and each business associated with each developed property.

Additional features of the invention include game tokens representing the different business types permitted in the different zoning player designations, playing pieces, one for each game player and means for randomly determining the number of spaces of movement of the playing pieces such as a pair of dice.

BRIEF DESCRIPTION OF THE DRAWINGS

The invention will be better understood after reading the following Detailed Description of the Preferred Embodiment in conjunction with the drawings in which:

FIG. 1 is a plan view of a game board according to the invention;

FIG. 2 is a perspective view of a representative playing piece representing a game player;

FIG. 3 is a perspective view of a representative game token representing one of the different business types;

FIGS. 4 and **4*a*** are plan views of opposite sides of a "Building Permit" card;

FIG. 9 is a plan view of a representative "Deed" card to an undeveloped property;

FIG. 10 is a plan view of a representative "Deed" card to a developed property;

FIG. 11 is a plan view of a representative "Deed" card to a business associated with a developed property;

FIG. 12 is a perspective view of a pair of dice representative of one means for randomly determining a number of spaces of movement of a playing piece;

FIG. 13 is an enlarged view of one undeveloped property space on the game board in FIG. 1 showing in detail the preferred indicia identifying the space; and FIG. 14 is is an enlarged view of one developed property space on the game board in FIG. 1 showing in detail the preferred indicia identifying the space.

DETAILED DESCRIPTION OF THE PREFERRED EMBODIMENT

Figures 5, 5A, 6, 6A, 7, 7A, 8:
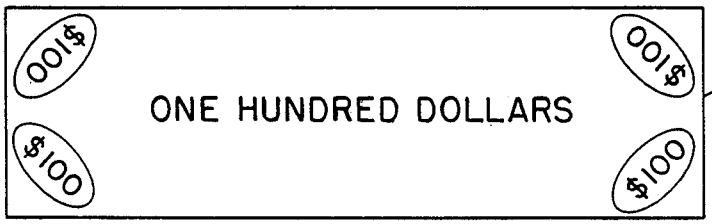
FIGS. 5 and **5*a*** are plan views of opposite sides of a representative "Audit" card.
FIGS. 6 and **6*a*** are plan views of opposite sides of a representative "Tax Man" card.
FIGS. 7 and **7*a*** are plan views of opposite sides of a representative chance situation "Lottery" card.
FIG. 8 is a plan view of one representative bill of a money source.

The game of the present invention comprises a game board 10, a plurality of playing pieces 12, each representing a different game player, means operable by the players for randomly determining the number of spaces of movement of the playing spaces, such as a spinner or dice 14, a plurality of game cards having different generally adverse and favorable consequences to a player's position in the game, such as for example tax consequence situations denoted as "Tax Man" cards 16, financial audit-type consequences denoted as "Audit" cards 18 and generally unforseeable chance-type situations denoted as "Lottery" cards 20. A listing of suggested specific situations and consequences for a set of each type of game card is given in Tables I, II and III below. The game further comprises a set of "Deed" cards 22, 23, 25 for developed property D1–D16, for undeveloped property U1–U4 and for various businesses B1–B16 associated with each developed property D1–D16, a plurality of "Building Permit" cards 24, game tokens 26 representing different types of businesses and a supply of simulated money 28.

Referring to FIG. 1, the game board 10 is preferably a square, planer, paperboard product having an endless game path along its perimeter subdivided into a plurality of spaces along which the players in turn move their respective playing pieces as determined by the roll of the dice 14. The game path includes a plurality of developed property spaces D1–D16 each having a different business B1–B16 associated therewith, as set out in the tables below. Each developed property space includes indicia identifying the property by its address and the associated business by name as shown in FIG. 14. The location of each developed property and associated business on the game path is identified by matching the space label numbers D1–D16 and B1–B16 in FIG. 1 with the corresponding number of the property and business designated in Tables VI and VII. For the purpose of playing the game, as set out herein below, each developed property has a designated purchase cost, rental value and mortgage value and each business associated with each developed property has a purchase cost, a dividend value and a mortgage value. If desired, and preferably, indicia of the different purchase costs, rental and dividend values and mortgage values of the property and business can be printed directly on each property space D1–D16 as shown in the enlarged view of one developed property space D4, B4 in FIG. 14. As noted, each developed property space and associated business has a separate "Deed" card 22, 25 each also having indicia of the respective purchase cost, rental, dividend value and mortgage values. Representative "Deed" cards for one developed property space D11 and for one business B3 are shown in FIGS. 10 and 11.

Still referring to FIG. 1, the game path also includes a plurality of undeveloped property spaces U1–U4 having indicia of at least the property name and address as shown in FIG. 13. The location of each undeveloped property space U1–U4 on the game path is identified by matching the space label U1–U4 in FIG. 1 with the corresponding number of the undeveloped property designated in Table VIII. For the purpose of playing the game, as set out below, each undeveloped property U1–U4 has a purchase cost an undeveloped rental value, a developed rental value greater than the undeveloped rental value and a mortgage value. Additionally, each undeveloped property is subject to a zoning designation I, II, III or IV defining the type or types and number of different businesses that maybe developed on the property. As with the developed property spaces, it is preferred that each undeveloped property space on the game board include indicia of the associated purchase cost, rental and mortgage values and zoning designation as shown in the enlarged view of one undeveloped property space U1 in FIG. 13. As noted, each undeveloped property has an associated "Deed" card 23, as shown in FIG. 9, having indicia of its purchase cost, rental values and mortgage value.

The game path further includes at least one, and preferably one along each of the four portions of the square path, "Building Permit" space 34, "Tax Man" space 36 and "Lottery" space 37. The game path is also provided with an "Audit" space 38, a Bank/Salary" space 40, which also designates the game starting point and a "Bankruptcy" space 42 which, in the embodiment shown, are located at corners of the path 10. An additional charity space 44 labeled "Gift to Poor 10%" for triggering payment of a predetermined sum of money is also provided. During play, the "Audit", "Lottery" and "Tax Man" spaces trigger different consequences either favorable or adverse to a player whose playing piece occupies the space as determined by the consequences and situations set out on the associated "Audit", "Lottery" or "Tax Man" cards which are randomly stacked on the game board on the respective designated locations 46, 48, 50. Representative "Audit", "Tax Man" and "Lottery" cards are shown in FIGS. 5, 5*a*, 6, 6*a*, 7 and 7*a*. Likewise, occupying the "Bankruptcy" space triggers a player having to turn in all property and businesses owned to the board bank, while passing the "Bank/Salary" space triggers the payment of a fixed sum of money to the player. The "Building Permit" cards 24 are all identical and include the indicia as set out in Table IV below and shown in FIG. 4*a* identifying the different costs to construct and the different dividend values of the different businesses available to be constructed on the various undeveloped property spaces in accordance with the associated zoning designations which are identified on the undeveloped property spaces, see FIG. 14. The "Building Permit" cards are preferably stacked on the game board at location 52 during play. The various adverse and favorable consequence as defined by the "Tax Man", "Lottery" and "Audit" cards can, of course, encompass a broad range of situations and consequences and those listed below are not to be considered exhaustive and the invention is not to be considered limited to the specific situations set out. Also, it is understood that more than one card for any situation may be included in a set of cards for the game. Further, the adverse and favorable consequences can relate to situations other than tax, chance or financial audit situations. These topics are only preferred since they are of course related to effecting a person's financial wealth and are thus appropriate to the theme of the game. Similarly, the properties and businesses identified by the "Deed" cards and "Building Permit" cards are also only representative.

The following is a tabulation of different preferred situations and consequences for a set of "Lottery", "Audit" and "Tax Man" game cards, a tabulation of different businesses and corresponding purchase costs and dividend values as designated on a set of "Building Permit" cards, an identification of the different zoning designations and a tabulation of the "Deed" cards for the developed properties, for the businesses associated with the developed properties and for the undeveloped properties, each giving the associated purchase costs, rental, dividend and mortgage values and zoning designations and limitations where applicable.

TABLE I

1. Over-night trip to the "$1,000,000 Casino". Collect $25,000 from board bank.
2. Advance player piece to "Tanner Travel Agent". Pay no rent on property or business, but receive $250 refund for overcharge on vacation from business owner.
3. Advance player piece to "City National Bank". Pay no rent to property or business owner however, receive $500 investment dividend from owner of business.
4. Accident insurance. Save for relief from accident loss.
5. Picked winning "Lottery" ticket. Collect $10,000 from board bank.
6. Tax refund in your favor. Receive $500 from board bank.
7. Advance player piece to nearest "Building Permit" space. May purchase permit and construct at this time.
8. Picked winning "Lottery" ticket, collect $25,000 from board bank.
9. You have a good attorney. Relief from court judgement. Collect $25,000. You may elect to receive payment and save card for future judgement relief.
10. Instant cash. Collect $10,000 from board bank.
11. Advance player piece to "Bank/Salary" space and collect twice your salary from board bank.
12. Theft insurance. Save for relief from theft loss.
13. Fire insurance. Save for relief from fire loss.
14. Advance player piece to "Forest Savings & Loan". Pay no rent to property or business owner, however, receive from business owner $750 interest dividend.
15. Audit relief, to be saved until needed to be used for audit relief.
16. Bankruptcy relief. Can be saved until needed for relief from forced bankruptcy.
17. Advance player piece to "Bolton Insurance Co." space. You pay no rent to property owner. Pay business owner $250 for insurance policy, for fire, theft and accident. May be saved for future relief from loss.
18. Winning night at bingo parlor. Collect $100 from each player.

TABLE II

Audit Cards

1. Penalty, tax filing error, audit shows error in filing income tax. Pay board bank 10% of cash-on-hand.
2. Audit of property tax for the past 5 years shows error. Pay $750 penalty to board bank.
3. Tax penalty. Pay board bank $5,000.
4. Convicted of selling black market computer programs. Penalty, pay $25,000 to board bank. If you do not own "Ace Computer, Inc." no fine due.
5. Results of tax audit shows error in filing taxes for past 5 years. Penalty, 10% of all cash-on-hand and 10% of mortgage value of all property and businesses payable to board bank. If no property or business owned than pay 10% of cash-on-hand only.
6. Convicted of tax evasion. Penalty, $25,000 payable to board bank.
7. Results of bank audit found in your favor. Collect 10% of your cash-on-hand from board bank.
8. Results of tax audit found in your favor. Collect 3,500 from board bank.
9. Convicted of being slum lord by Housing Commission. Lose two turns on roll of dice. Pay $50,000 fine to board bank. While play continues do not collect rent on property or businesses until after next turn.
10. Convicted of being slum loard by Housing Commission. Pay $5,000 to board bank for each condominium and $2,500 for each apartment that you have constructed.
11. Convicted of selling black market video tapes. Penalty, $25,000 to board bank. If you do not own "Video Magic Rental", no fine due.
12. Penalty, results of audit of illegal business practice. Pay $10,000 to board bank.
13. Insurance commission investigation. Convicted of poor insurance protection. Pay board bank $10,000. If you possess fire insurance "Lottery" card no penalty due.
14. Tax audit on board property found in your favor. Collect 10% of mortgage value of all property owned from board bank.

TABLE III

Tax Man Cards

1. Fire damage to apartment building. Pay $2,500 to board bank. If you possess "Lottery" card for fire insurance, no penalty due.
2. Personal injury law suit. Pay board bank $2,500. If you possess "Lottery" card for accident insurance, no payment due.
3. Penalty. Late penalty assessed for filing taxes late. $1,500 payable to board bank.
4. Charity contribution. Pay $100 to board bank.
5. Penalty, late mortgage payment assessed. Penalty of total property and business owned. 10% of mortgage value of all property and business owned payable to board bank.
6. Penalty, state and local tax filed late. Pay $1000 to board bank.
7. Property tax assessment. Pay 10% of board value of all property owned to board bank.
8. Advance playing piece to "Audit" space, draw card and carry out instructions on card.
9. Court judgement against you for unfair labor practice. Appeal unsuccessful. Pay board bank $25,000. Court judgement relief "Lottery" card accepted as payment.
10. Charity fund raiser of $100 per plate. Pay board $200.
11. Business tax assessment. Pay $1,000 for each business owned to board bank.
12. Advance playing piece to "City State College" space. School tax contribution. Pay business owner $500. No rent due to land owner.
13. Property theft loss. Pay board bank $2,000. If you possess "Lottery" card for theft insurance. No payment due.
14. Penalty. Unfair labor practice in your business. Pay $5,000 to board bank.
15. Penalty assessed for undeveloped property. Pay $500 for each undeveloped property deed owned payable to board bank.
16. Advance playing piece to "Bankruptcy" space. Render all property and businesses to board bank and receive mortgage value.
17. Stock market loss. Pay board bank $1,500.
18. Advance playing piece to "hillcrest Medical Center" space. Emergency surgery, pay business owner $5,000. If business is unowned, return card to pile. If unowned, business may be purchased. Land owner receives no rent. If you possess "Lottery" card for insurance policy, then no payment to medical center due.

19. Penalty assessment for undeveloped property. Pay $1,000 for each undeveloped property owned to board bank.
20. Tax assessed for cash-on-hand. Pay 10% of all cash-on-hand to board bank.

TABLE IV

| Business | Building Permit Cards Cost | Dividend |
|---|---|---|
| Floppy Burger Franchise | $2,500 | $600 |
| Video Magic Rental Store | 2,250 | 500 |
| Ace Computer, Inc. | 5,000 | 1,500 |
| Apartment Complex | 10,000 | 2,500 |
| Condominiums | 15,000 | 3,500 |

TABLE V

| Zoning Designation | |
|---|---|
| Zone I | Apartment Houses |
| Zone II | Condominiums |
| Zone III | Resturants |
| Zone IV | Private Business |

TABLE VI

| Property | | Deed Cards Property Cost | Rent | Mortgage Value |
|---|---|---|---|---|
| D1 | Harris Street | $2,500 | $250 | $1,250 |
| D2 | Harvard Ave. | 2,500 | 250 | 1,250 |
| D3 | Clark Street | 3,000 | 300 | 1,500 |
| D4 | Water Street | 1,500 | 150 | 750 |
| D5 | College Blvd. | 4,500 | 450 | 2,250 |
| D6 | Blue Island Lane | 10,000 | 1,000 | 5,000 |
| D7 | Hillcrest Ave. (2610) | 100,000 | 7,500 | 50,000 |
| D8 | Main Street | 5,000 | 400 | 2,500 |
| D9 | Hillcrest Avenue (2510) | 200,000 | 20,000 | 100,000 |
| D10 | Sewer Street | 2,000 | 200 | 1,000 |
| D11 | Main Street #1 | 100,000 | 5,500 | 50,000 |
| D12 | Beverly Cove Ave. | 15,000 | 1,500 | 7,500 |
| D13 | Electric Drive | 5,000 | 250 | 2,500 |
| D14 | Beach Drive | 25,000 | 2,000 | 2,500 |
| D15 | Beach Lane | 200,000 | 20,000 | 100,000 |
| D16 | Main Street #15 | 75,000 | 6,500 | 37,500 |

TABLE VII

| Business | | Deed Cards Business Cost | Dividend | Mortgage Value |
|---|---|---|---|---|
| B1 | City State College | $5,000 | $500 | $2,500 |
| B2 | Forest Mercedez Dealer | 50,000 | 5,000 | 2,500 |
| B3 | Tanner Travel Agency | 5,000 | 350 | 2,500 |
| B4 | Dept. of Water | 2,000 | 150 | 1,000 |
| B5 | Big Top Pizza Parlor | 6,000 | 600 | 3,000 |
| B6 | Manhatten Arms Apts. | 50,000 | 5,000 | 25,000 |
| B7 | Hillcrest Medical center | 400,000 | 30,000 | 200,000 |

TABLE VII-continued

| Business | | Deed Cards Business Cost | Dividend | Mortgage Value |
|---|---|---|---|---|
| B8 | Bolton Ins. Company | 10,000 | 550 | 5,000 |
| B9 | Stone Med. Arts Building | 250,000 | 12,500 | 125,000 |
| B10 | Dept. of Sewage | 3,000 | 250 | 1,500 |
| B11 | City Nat'l Bank | 250,000 | 25,000 | 125,000 |
| B12 | Beverly Glen Apts. & Condos | 75,000 | 6,000 | 37,500 |
| 13 | Dept. of Electricity | 10,000 | 600 | 5,000 |
| B14 | Bayshore Condos & Yacht Club | 125,000 | 10,000 | 62,500 |
| B15 | Malibu Townhouse & Condos | 250,000 | 25,000 | 125,000 |
| B16 | Forest Savings & Loan | 175,000 | 10,000 | 87,500 |

TABLE VIII

| Property | Deed Cards Undeveloped Property | |
|---|---|---|
| U1 | North Avenue | |
| | Cost: | $2,000 |
| | Undeveloped Rent: | 100 |
| | Developed Rent: | 300 |
| | Mortgage Value: | 1,000 |
| | Zoning: IV any commercial development up to: 2 condos, 2 apt. bldgs. | |
| U2 | Murry Street | |
| | Cost: | 3,000 |
| | Undeveloped Rent: | 150 |
| | Developed Rent: | 450 |
| | Mortgage Value: | 1,500 |
| | Zoning: IV any commercial or other develop. up to: 4 condos, 3 apts. bldgs. | |
| U3 | Beach Drive #1 | |
| | Cost: | 20,000 |
| | Undeveloped Rent: | 2,000 |
| | Developed Rent: | 3,000 |
| | Mortgage Value: | 10,000 |
| | Zoning: I-II any type residential or multi-level resid. up to: 4 condos, 2 apt. bldgs. | |
| U4 | Mulhulland Parkway | |
| | Cost: | 125,000 |
| | Undeveloped Rent: | 20,000 |
| | Developed Rent: | 28,500 |
| | Mortgage Value: | 62,500 |
| | Zoning: I-II any type residential or multi-level residential up to: 4 condos, 4 apt. bldgs. | |

METHOD OF PLAY

The object of the game is for each player to systematically move his playing piece around the game path by using the throw of the dice to determine the number of spaces of movement and investing in the various properties and businesses, collecting the various rents and dividends to build a financial wealth greater than an opponent's while subjected to adverse or favorable consequences of the "Lottery", an "Audit", the "Tax Man" or forced bankruptcy. The game requires a minimum of two players or as many as eight. The players choose one person to act as the board banker. The board banker distributes the following denominations of money to each player: 5—$10 bills; 5—$20 bills; 5—$50 bills; 6—$100 bills; 9—$1,000 bills; 2—$5,000 bills; 3—$10,000 bills and 1—$50,000 bill for a total of $100,000. Each player selects a playing piece and places it on the space marked "Bank/Salary". The board banker at this time shuffles all of the "Deed" cards to the board property and businesses and then in a clockwise manner deals out two deeds to each player. Each player then must pay the board banker the cost of each property or business which was dealt to him. In the event that the player is unable to afford to buy any of the properties or businesses dealt to him at this time, the "Deed" is returned to the board banker with no exchange allowed. No construction is allowed by a player until he has moved one complete cycle of the game board path and has past the "Bank/Salary space". Also, to allow construction to take place at any future time during the course of the game, the player wanting to do so must purchase a "Building Permit" which he may do upon landing on a space designated "Building Permits".

At this time, each player roles the dice to determine which player will play first. The player who roles the highest number plays first and play then continues in a clockwise manner. If a player should role doubles on the dice, then he finishes that play and roles again. There is no limit to the number of consecutive turns a player may take as long as he maintains control of the dice and the game board.

The board banker also shuffles the game cards and places them face down on the appropriate spots on the game board.

On his turn, the player in a clockwise manner roles the dice to determine the number of spaces to be moved and he moves his playing space to the appropriate board space at which time he has several options:

1. If the property or business designated on the space is owned, then he must pay the designated rent on the property and/or the designated dividend for the business to the owner;

2. If the property is owned and the business is not, then he must pay the designated property rent to the owner and then if desired purchase the business from the board bank;

3. If the business is owned and the property is not, then he must pay the dividend to the owner of the business and, if desired, purchase the property from the board bank; or 4. If neither the property nor the business is owned, then the player landing on the space has the option to purchase either the property or the business but not both at the same time. For the same player to purchase the remaining property or business he must land on the space again. If the next player should land on the same space, he would pay the player owning the "Deed" to the property or business the appropriate rent or dividend and then, if desired, purchase that portion of the space not owned. Once the property and the business are both owned, then any person landing on that space would pay the rent to the property owner and a dividend to the business owner. If the property owner or the business owner should land on the space, then he would pay the co-owner the designated rent or dividend, whichever is appropriate. If a player should land on the space which is owned entirely by one player then he must pay both the rent and the dividend to that player. If the owner of both the property and the business should land on the space then this is a safe space for that individual with no rent or dividend due.

If a player should land on a space marked "Undeveloped Property", then he could purchase that property at that time. The rent is lower on undeveloped properties but, with construction or improvements, the rent value increases. To develope the land, a player must land on the space marked "Building Permits" at which time he can purchase a "Building Permit" to allow construction on that site. The cost of the "Building Permit" is $150 and is paid to the board banker. If a player lands on undeveloped property and already owns a "Building Permit", he can purchase the undeveloped property but cannot construct on that site until his next turn, unless the player has rolled a doubles on the dice, in which case he has another turn coming and he may elect to construct at that time. If a player owns a piece of undeveloped land and he should land on the space marked "Building Permits", then he can purchase the "Building Permit" and construct on that site at that time if he has the funds to do so. Once a "Building Permit" card has been used, it must be maintained by the owner to determine the appropriate dividend for the construction which is printed on the "Building Permit" card. The mortgage value of the now developed property does not change with the development, however, once construction has taken place, should the property be mortgaged, the player gets back one-half the construction costs from the bank. The type of construction permitted on any undeveloped property space is determined by its zoning designation as set out on the property space. The cost of constructing a particular business allowed by the zoning is set out on the "Building Permits" as noted above. Once construction is completed, the owner can collect an increased rent for the now developed property, as shown on the property space, see FIG. 13, and a dividend for a particular business constructed which is also given on the "Building Permit". Construction of a business is indicated by the issuance by the board banker of a game token representing the particular business developed which is placed on the property space.

Regarding the zoning designations, a player may construct any type of business allowed by the given zoning designation or any lower designation but, if there are limits to the amount of construction allowed, they are stated in the zoning designation for the particular undeveloped property on the game board space as shown in FIG. 13. Table VIII gives the zoning designations and limits to construction for all undeveloped property spaces. These data would be printed on each appropriate undeveloped property space in the manner shown in FIG. 13. For example, if a player lands on an undeveloped property space with a "Zone IV" designation such as North Ave. shown in FIG. 13, then that player can construct any type of private business as well as any construction allowed in Zones I, II, and III up to two condominiums and two apartment buildings. Therefore, for a Zone IV zoning, a player could construct one restaurant, one private business and a designated number of apartment buildings and condominiums with the cost of construction of each being as designated on the "Building Permit" card. The player would accordingly collect a developed rent and an accumulated dividend depending on the total construction on the property. By way of a further example, if a player lands on a Zone I and II undeveloped property space, such as Beach Drive #1, space U3 in FIG. 1, as shown in Table VIII, he could construct the designated number of apartment buildings and condominiums but no restaurants or private business.

During play, if a player lands on the "Lottery", "Tax Man" or "Audit" spaces, the player draws the top card from the appropriate stack and must comply with the instruction given. All fines and penalties are paid to the board banker. Should a player not have enough money to pay a fine or a penalty given, he must mortgage property and/or business which he owns back to the bank to raise the money with the right to repurchase it for the same cost or, alternatively, the player may auction any property or business owned to one of the other players. When property or business is mortgaged, no rent or dividend can be collected should a player land on the space.

Some audit consequences set out in the "Audit" cards may assess a penalty to a player relating to a certain type of construction. If a player draws such a card but has not completed the type of construction subject to the penalty, the card instruction maybe ignored and the card returned to the stack.

Should a player land on the "Bankruptcy" space, the player must return all property and/or business deeds which he owns to the board banker and will receive the mortgage value of the property and the businesses. The player in a bankruptcy situation will also receive one-half the cost of all construction completed by him. Bankruptcy can be avoided if the player holds a bankruptcy relief card previously drawn from the "Lottery" cards, for example card 16 in Table I.

If a player lands on the "Gift to Poor" 10% space, he must pay 10% of all cash-on-hand to the "Bank/Salary" space which will be awarded to the first player to land exactly on the "Bank/Salary" space. Should a player land on the "Bank/Salary" space exactly but no "Gift to Poor" funds have been collected, the player will receive $150,000 from the board bank. Also, each time a player lands on or passes the "Bank/Salary" space, he will collect $2,500.

As noted, if a player should mortgage property or business to the board bank, then no rent or dividend can be collected on these properties or businesses while mortgaged. When repurchased from the board bank at the same mortgage price, the player may again collect rent or dividends. The mortgage value of the business and property is given on the associated "Deed" card and is typically one-half the original purchase cost of the business or property. If developed property is mortgaged, the bank pays the mortgage value of the property plus one-half the cost of any construction completed on the property.

The game continues on either for a predetermined playing time or until the players mutually agree to terminate play at which time the player having the greatest wealth in terms of cash and value of property and businesses is declared the winner. Should a player leave the game and have mortgaged property or businesses in the bank, these properties or businesses are placed back on the market for sale. Further, if a player withdraws from the game, all of his money and properties are returned to the board bank less any money used to repay rent and dividends to another player.

Having described the preferred embodiment of the invention, those skilled in the art having the benefit of the description and the accompanying drawings can readily devise other embodiments and modifications and such other embodiments and modifications are to be considered to be within the scope of the appended claims.

What is claimed is:

1. A board game comprising:

a plurality of playing pieces, each playing piece representing a different player;

a supply of simulated money defining a medium of monetary exchange;

means operable by each player for randomly determining a number of spaces of movement of said playing pieces;

a game board including an endless path of adjacent spaces including a first plurality of spaces, each defining a developed property including a business, a second plurality of spaces, each defining an undeveloped property having a zoning designation defining at least one of a plurality of different businesses permitted to be developed on said undeveloped property, wherein the zoning designation of an undeveloped property being different from at least one other undeveloped property at least one building permit space, at least one space for triggering a consequence generally adverse to said player and at least one space for triggering a consequence generally advantageous to said player;

a plurality of building permit cards, each building permit card defining each of the plurality of different businesses for said zoning designations;

a plurality of adverse consequence cards to be randomly drawn by said players when occuping said at least one space for triggering said consequence adverse to said player, said adverse consequence cards defining different adverse consequences;

a plurality of favorable consequence cards to be randomly drawn by said players when occupying said at least one space for triggering said consequence favorable to said players, said favorable consequence cards defining different favorable consequences; and means for indicating development of said undeveloped property with said permitted different businesses.

2. The board game as defined in claim 1 wherein said path includes a space for triggering the payment of a predetermined sum of said money to said player each time said player's playing piece passes said space for triggering payment of said predetermined sum of money.

3. The board game as defined in claim 2 further including a plurality of deed cards one for each developed property, one for each business associated with each developed property and one for each undeveloped property.

4. The board game as defined in claim 3 wherein said at least one space for triggering a consequence adverse to said player and said plurality of adverse consequence cards relate to tax.

5. The board game as defined in claim 4 wherein said at least one space for triggering a consequence favorable to a player and said plurality of favorable consequence cards relate to generally unforseeable chance situations.

6. The board game as defined in claim 5 wherein said at least one space for triggering a consequence favorable to said player and said plurality of favorable consequence cards are labeled as lottery cards.

7. The board game as defined in claim 5 wherein said at least one space for triggering a consequence adverse to said player includes a space and a plurality of cards relating to a financial audit situation.

8. The board game as defined in claim 7 wherein at least some of said plurality of cards relating to said financial audit situation define consequences favorable to a player.

9. The board game as defined in claim 7 wherein said path includes at least one charitable gift space triggering the payment of a sum of said money by a player whose playing piece occupies said charitable gift space.

10. The board game as defined in claim 9 wherein said path includes a space for triggering bankruptcy of a player whose playing piece occupies said space for triggering bankruptcy.

11. The board game as defined in claim 10 wherein said deed cards for each said developed property indicates a purchase cost, a rental value and a mortgage value of the associated developed property, said deed card for each business associated with each developed property indicates a business purchase cost, a dividend valve and a mortgage value of the associated business and each deed card for each undeveloped property indicates a purchase cost, an undeveloped rental value a developed rental value and a mortgage value.

12. The board game as defined in claim 11 wherein said means for indicating development of said undeveloped property includes a plurality of tokens representing said different permitted businesses.

13. A board game comprising:

a plurality of playing pieces, each playing piece representing a different player;

a supply of simulated money defining a medium of monetary exchange;

means for randomly determining a number of spaces of movement of said playing pieces;

a game board including an endless path over which said playing pieces are moved in accordance with the means for randomly determining, said path including a plurality of developed property spaces, each having an associated business, a plurality of undeveloped property spaces each having a zoning designation defining at least one of a plurality of different businesses permitted to be developed on said undeveloped property, wherein the zoning designation of an undeveloped property being different from at least one other undeveloped property, a plurality of tax consequence triggering spaces, a plurality of chance typesituation triggering spaces, a financial audit consequence triggering space, a plurality of building permit purchase spaces, a bankruptcy triggering space, a charitable gift triggering space and a player money entitlement space, said path arranged along substantially the periphery of said game board;

a plurality of randomly arranged tax consequence cards defining different tax consequences to a player whose playing piece occupies one of said tax consequence triggering spaces;

a plurality of randomly arranged financial audit consequence cards defining different financial audit consequences to a player whose playing piece occupies one of said financial audit consequence spaces;

a plurality of building permit cards defining the purchase cost and dividend value of different business types buildable on at least one of said undeveloped property spaces, said building permit cards purchasable by a player whose playing piece occupies a building permit space;

a plurality of randomly arranged chance situation cards defining different unforseeable chance consequences applicable to a player whose playing piece occupies said chance situation triggering space; and a plurality of tokens representing the different business types buildable on said undeveloped property spaces.

14. A board game comprising:

a plurality of playing pieces, each playing piece representing a different player;

a supply of simulated money defining a medium of monetary exchange;

random numerical indicator means operable by each player for indicating a number of spaces of movement of said playing pieces;

a game board having a plurality of adjacent spaces defining an endless path along which said playing pieces are moved by each player in accordance with said random numerical indicator means, said plurality of adjacent spaces including a plurality of developed property spaces, each developed property space having a property purchase cost, a property rental value, a property mortgage value, a business purchase cost of a business associated therewith, a dividend value of the associated business and a business mortgage value, a plurality of undeveloped property spaces, each undeveloped property space having an undeveloped property purchase cost, an undeveloped property rental value, an undeveloped property mortgage value and a developed rental value, each undeveloped property space having a zoning designation defining at least one of a plurality of different businesses permitted to be developed on said undeveloped property space, at least one tax consequence space, at least one lottery space, at least one building permit space, at least one bankruptcy space, at least one audit space, at least one space defining a charitable contribution to be given by said player and a game starting space;

a plurality of building permit cards, each stating a cost of construction and a dividend value for each of said plurality of different businesses;

a plurality of tax cards each describing a tax consequence effecting a player;

a plurality of audit cards each describing a situation having a financial consequence effecting a player;

a plurality of lottery cards each describing an event having a generally favorable consequence effecting a player;

a plurality of deed cards one for each of said developed property spaces, one for each business associated with each of said developed property spaces and one for each undeveloped property space, said deed cards indicating the respective developed and undeveloped property and business purchase costs, developed and undeveloped rental values, dividend value and mortgage values; and a plurality of tokens representing each of said different businesses permitted to be developed on said undeveloped property spaces.

* * * * *